United States Patent [19]

Epstein et al.

[11] 3,952,081

[45] Apr. 20, 1976

[54] PRODUCTION OF CELLULOSE ACETATE FILAMENTARY MATERIAL

[75] Inventors: Martin E. Epstein, Basking Ridge; Henry H. George, Jr., Berkely Heights, both of N.J.

[73] Assignee: Celanese Corporation, New York, N.Y.

[22] Filed: Apr. 15, 1974

[21] Appl. No.: 461,032

[52] U.S. Cl. ..... 264/207; 106/187; 106/189; 106/196; 264/211

[51] Int. Cl.[2] ..... D01F 3/26

[58] Field of Search ..... 264/207, 205, 211; 106/196, 187, 189

[56] References Cited

UNITED STATES PATENTS

| | | | |
|---|---|---|---|
| 1,616,787 | 2/1927 | Dreyfus | 264/207 |
| 1,920,212 | 8/1933 | Payne et al. | 264/207 |
| 2,075,890 | 4/1937 | Dreyfus | 264/207 |
| 2,435,999 | 2/1948 | Dreyfus et al. | 106/189 |
| 2,695,835 | 11/1954 | Hare | 264/206 |
| 3,342,921 | 9/1967 | Brundige et al. | 264/207 |
| 3,482,011 | 12/1969 | Bohrer et al. | 264/207 |
| 3,740,940 | 6/1973 | Berkowitch | 57/140 R |
| 3,770,856 | 11/1973 | Ueki et al. | 260/34.2 |

*Primary Examiner*—Jay H. Woo

[57] ABSTRACT

An improved process is provided for the formation of cellulose acetate filamentary material and film. Secondary cellulose acetate is dissolved in a solvent at an elevated temperature and elevated pressure to form a homogeneous solution, with the solvent being incapable of dissolving the secondary cellulose acetate at ambient conditions. The cellulose acetate solution is extruded through an appropriate shaped orifice into a gaseous atmosphere provided at substantially atmospheric pressure. A rapid precipitation or phase separation reaction occurs in the gaseous atmosphere wherein the solvent separates from the cellulose acetate to form a solid filamentary material or film which is subsequently collected. The solid product may be dried to remove remaining traces of solvent. The process is capable of implementation at rapid spinning speeds while utilizing relatively short zones wherein the phase separation is accomplished.

16 Claims, No Drawings

PRODUCTION OF CELLULOSE ACETATE FILAMENTARY MATERIAL

BACKGROUND OF THE INVENTION

Shaped articles of cellulose acetate, e.g. fibers and films, have achieved widescale commercial acceptance.

Cellulose acetate wherein not less than 92 percent of the hydroxyl groups are acetylated and which contains an acetic acid content of about 60.6 to 62.5 percent is commonly referred to as cellulose triacetate or primary cellulose acetate. Cellulose acetate wherein the molecular structure is partially hydrolyzed until an average of 2 to 2.5 acetate groups remain per glucose unit is commonly referred to as secondary cellulose acetate and commonly contains a lesser acetic acid content of about 54 to 59 percent.

Solvent evaporation techniques (e.g. dry spinning) heretofore have been utilized when forming shaped articles of cellulose acetate. As is well known in the art, the solubilities of cellulose triacetate and secondary cellulose acetate differ greatly. Accordingly, methylene chloride is commonly utilized as the major solvent when spinning solutions of cellulose triacetate, and acetone is commonly utilized as the primary solvent when spinning solutions of secondary cellulose acetate. While methylene chloride will dissolve secondary cellulose acetate, it has not been used commercially with this material for historical and economic considerations. Solutions of secondary cellulose acetate in acetone (e.g. 95.5 percent by weight) and water (e.g. 4.5 percent by weight) commonly have been extruded into an evaporation zone (e.g. warm air) wherein the solvent is evaporated to leave a product of almost pure secondary cellulose acetate. Installation costs for such a dry spinning operation tend to be great. Spinning speeds tend to be limited by the residence time required to evolve the solvent, and the reduced strength of the spin line while large quantities of solvent are present. Considerable capital and operational expense is involved in solvent recovery from the evaporative atmosphere.

Certain fiber-forming processes have been proposed in the past wherein specific fibers other than cellulose acetate have been formed through the utilization of phase separation from designated solvent systems which may be accomplished by a pressure differential. See, for instance, the work reported by M. M. Zwick in Applied Polymer Symposia, No. 6, pages 109–149 (1967) Interscience Publishers.

It is an object of the present invention to provide an improved process for the production of secondary cellulose acetate filamentary material and film.

It is an object of the present invention to provide an improved process for the production of secondary cellulose acetate filamentary material and film which can be carried out at a rapid rate in a relatively small area.

It is an object of the present invention to provide an improved process for the production of secondary cellulose acetate filamentary material which may be more economically implemented than dry spinning processes commonly utilized in the prior art.

It is another object of the present invention to provide an improved process for the production of a secondary celluose acetate filamentary material which readily may be employed to form a multifilament tow of an unusually high filament count.

It is a further object of the present invention to provide an improved process for the production of secondary cellulose acetate filamentary material and film wherein the spinning solvent may be recovered as a concentrated vapor, thereby reducing solvent recovery and purification costs.

These and other objects, as well as the scope, nature, and utilization of the process will be apparent to those skilled in the art from the following description and appended claims.

SUMMARY OF THE INVENTION

It has been found that an improved process for the production of a cellulose acetate filamentary material or film comprises:

a. dissolving secondary cellulose acetate in a solvent at a temperature of about 75° to 150°C. while at superatmospheric pressure to form a homogeneous solution, with said solvent being incapable of dissolving said secondary cellulose acetate at ambient conditions, b. passing the homogeneous solution through a shaped extrusion orifice into a gaseous atmosphere provided at substantially atmospheric pressure wherein the extruded solution undergoes a phase separation to form a solid cellulose acetate filamentary material or film, and c. collecting the solid cellulose acetate filamentary material or film.

DESCRIPTION OF PREFERRED EMBODIMENTS

In the process of the present invention a homogeneous solution initially is formed by dissolving secondary cellulose acetate in solvent at an elevated temperature and elevated pressure which is incapable of dissolving the same at ambient conditions, i.e. 25°C. and atmospheric pressure.

The secondary cellulose acetate component may be procured in conventional flake or powder such as commonly employed to form cellulose acetate filamentary material and film via prior art techniques. Such polymer possesses a structure which has been partially hydrolyzed until an average of 2 to 2.5 acetate groups remain per glucose unit. The acetic acid content of the secondary cellulose acetate is about 54 to 59 percent. Also, the secondary cellulose acetate exhibits an inherent viscosity (I. V.) of about 1.5 to 3.0, and preferably an inherent viscosity of about 1.6 to 1.9 as determined from a solution of 0.1 gram of the secondary cellulose acetate in 100 ml. of 95 percent acetone and 5 percent water at 25°C.

It has been found in a preferred embodiment of the process that the desired homogeneous solution of cellulose acetate may be formed under appropriate solutioning conditions while employing a solvent wherein at least 50 percent by weight of the solvent exhibits a boiling point below about 80°C. at ambient conditions. Solvents are selected which result in no substantial degradation of the secondary cellulose acetate while dissolved therein. For instance, the solvent may consist primarily of methanol (e.g. consist of at least 75 percent methanol by weight). In a particularly preferred embodiment of the process the solvent is substantially all methanol. Other representative solvents include ethanol, ethanol in combination with a minor concentration of water, 40 to 60 percent by weight acetone in combination with 40 to 60 percent by weight water, etc. A minor proportion of a compatible supplementary organic solvent may be admixed with the major solvent component. It is essential that any supplementary component of the solvent not preclude the formation of the desired homogeneous solution. For instance, representative supplementary organic solvents which may be utilized in conjunction with methanol include: methyl ethyl ketone, methyl acetate, acetone, etc.

The solvent utilized to form the homogeneous solution of secondary cellulose acetate is incapable of dissolving the same at ambient conditions. Solutioning accordingly is accomplished at an elevated temperature and at an elevated pressure. The desired homogeneous solution may be formed at a temperature of about 75° to 150°C, and preferably at a temperature of about 95° to 120°C. The elevated pressure employed during solutioning conveniently may be that autogenously attained upon raising the solvent to the desired temperature in a closed chamber, however, the pressure is preferably 25 to 50 psi higher than that achieved autogenously. For instance, elevated pressures of about 75 to 200 psig, and preferably about 100 to 150 psig may be utilized. The secondary cellulose acetate is preferably added to the solvent in finely divided form and is agitated while undergoing dissolution. It is also recommended that the solutioning generally be accomplished at the lowest temperature possible to bring about dissolution so that any tendancy for the cellulose acetate to undergo degradation is minimized.

In order to avoid any possibility of the untoward obstruction of the extrusion orifice during the fiber or film formation step described hereafter the resulting solution may be filtered to remove any solids Homogeneous solutions are provided which contain cellulose acetate in a concentration of about 10 to 50 percent by weight based upon the total weight of the solution, and most preferably in a concentration of about 25 to 45 percent by weight based upon the total weight of the solution. It is, of course, essential that the solution be maintained under appropriate temperature and pressure conditions prior to passage through the extrusion orifice as described hereafter. As previously indicated, it is recommended that the solution be stored at the lowest temperature possible (e.g. about 95° to 100°C.) so that any tendency for the cellulose acetate to undergo degradation is minimized.

The shaped extrusion orifice or spinneret utilized during the extrusion may contain a single hole through which a single filament is extruded, and preferably contains a plurality of holes (e.g. of about 25 to 200 microns diameter) whereby a plurality of filaments may be simultaneously extruded to form a continuous length of a multifilament cellulose acetate filamentary material. The cross-sectional configuration of spinneret holes may be circular, triangular, or other geometric configuration. The as-spun filaments tend to exhibit a cross-section which generally corresponds to the configuration of the extrusion orifice. When forming a continuous filament yarn the spinneret may be provided with about 20 to 200 adjoining holes having a diameter of about 25 to 200 microns, and preferably a diameter of about 35 to 50 microns. When forming a continuous filament tow of greater total denier, the spinneret may be provided with about 250 to 10,000 adjoining holes having a diameter of about 25 to 200 microns, and preferably a diameter of about 35 to 50 microns. When forming a cellulose acetate film, the extrusion orifice may be a substantially rectangular slit. For instance, rectangular extrusion orifices having an opening thickness of about 1 to 10 mils may be utilized.

The shaped extrusion orifice preferably is maintained at a jet face temperature of about 95° to 120°C., and the homogeneous cellulose acetate solution at a temperature of about 95° to 120°C. when supplied to the same while at a pressure of not less than about 250 psig (e.g. 250 to 500 psig), and preferably at a pressure of 400 to 500 psig.

The homogeneous solution next is passed through the shaped extrusion orifice into a gaseous atmosphere provided at substantially atmospheric pressure (and preferably also at ambient temperature) wherein the extruded solution undergoes a phase separation to form a solid filamentary material or film.

The nature of the gaseous atmosphere is not critical to the operation of the present process so long as the gaseous atmosphere is not unduly reactive with cellulose acetate and does not degrade the properties thereof to any substantial degree. The gaseous atmosphere preferably is provided at a temperature of about 10° to 60°C., and most preferably at about 20° to 30°C. (e.g. room temperature at about 25°C.). In order to facilitate the volatilization and removal of the solvent following phase separation the gaseous atmosphere preferably is circulated. Representative gaseous atmospheres for use in the process include air, nitrogen, methanol, etc. The preferred gaseous atmosphere is air. However, when the gaseous atmosphere is methanol vapor, and the solvent is methanol there is no requirement that the volatilized methanol from the spinning solution be separated from another gas.

It has been found that when the cellulose acetate solution heretofore described emerges from the shaped extrusion orifice a rapid phase separation reaction takes place usually within about one centimeter of the jet face. The phase separation takes place between the solvent and polymer resulting in the immediate formation of a fully developed non-tacky solid filamentary material or film. The lower temperature and pressure of the gaseous atmosphere accordingly results in the precipitation of the cellulose acetate which assumes a configuration generally corresponding to that of the extrusion orifice. Since the phase separation reaction is rapid the minimum residence time within the gaseous atmosphere is commonly about 0.0001 second. The zone containing the gaseous atmosphere accordingly may be relatively short thereby facilitating a minimal capital expenditure. For instance, the zone containing the gaseous atmosphere may conveniently have a length of about 0.5 to 3 feet. The minimum length of the zone containing the gaseous atmosphere will vary to at least some degree with the take-up speed as will be apparent to those skilled in the art. The minimum length for a given process embodiment may be determined by routine experimentation. The longer the zone containing the gaseous atmosphere the greater the degree of the volatilization of the solvent prior to take-up.

The solid cellulose acetate filamentary material with or without adhering liquid solvent is next collected, such as by winding upon a support at a rate of about 50 to 5,000 meters per minute, and preferably at a rate of about 200 to 2,500 meters per minute. For instance, a yarn of about 20 to 200 continuous filaments may be collected by winding on a support at a rate of about 400 to 2,500 meters per minute, or a large continuous filament tow of about 250 to 10,000 filaments may be collected by winding on a support at a rate of about 200 to 1,000 meters per minute. Thin film conveniently may be collected by winding upon a support at a rate of about 100 to 500 meters per minute. The cellulose acetate filamentary material intermediate the shaped extrusion orifice and its point of collection commonly is subjected to a drawdown ratio of about 0.2:1 to 1.5:1. The "drawdown ratio" as used herein is defined as the ratio of the velocity of the spinning solution in the extrusion orifice to the velocity of the filamentary material at takeup.

If desired, the resulting solid continuous length of cellulose acetate filamentary material or film may be subjected to a drying step before or after collection to remove substantially all of the solvent. Such drying prior to collection may be conducted by utilizing an extended gaseous atmosphere into which the homogeneous solution is extruded or by passing the resulting filamentary material or film through a separate oven provided at a moderately elevated temperature (e.g. a circulating air oven at about 25° to 70°C.) below that at which the properties of the product would be adversely influenced. After collection, the support bearing the product alternatively may be placed in a similar oven until any remaining traces of solvent are volatilized. Volatilized solvent may be withdrawn throughout the process, condensed, and recycled for further use in solution preparation.

In a further embodiment of the process a multifilament cellulose acetate tow while still bearing traces of solvent may be passed to a crimper (e.g. a steam crimper), crimped, and dried.

The cellulose acetate filamentary material formed in the present process commonly possesses a denier per filament of about 2.5 to 15 (e.g. about 3 to 6). Cellulose acetate films of about 1 to 10 mils thickness alternatively may also be formed. Such filamentary materials and films may be utilized in end use applications where similar materials formed by prior art techniques heretofore have been utilized.

The dye uptake and moisture retain of the product are comparable to products formed by conventional dry spinning processes. Also, the initial modulus of the filamentary product tends to be higher than that commonly observed in products of the prior art. A detailed examination of the filamentary material reveals that it commonly exhibits crenulated surface characteristics and each fiber appears to possess an outer sheath of greater density than the fiber core. The filamentary material is particularly suited for textile applications and may be used to form staple fiber following crimping. Alternatively, large tows suitable for use in the production of cigarette filters may be formed. The cellulose acetate films may be utilized as packaging materials.

The following examples are given as specific illustrations of the process of the present invention. It should be understood, however, that the process is not limited to the specific details set forth in the examples.

EXAMPLE I

Secondary cellulose acetate flake having an I.V. of 1.67 measured by dissolving 0.1 gram of the polymer in 100 ml. of 95 percent acetone and 5 percent water at 25°C. is selected for use in the process. The secondary cellulose acetate has an acetic acid content of about 55.5 percent and has been partially hydrolyzed until an average of 2.3 acetate groups remain per glucose unit.

The flake is fed through a hammer mill to reduce its maximum particle size to about 40 mesh. The ground flake is slurried with methanol in a mixer operated at atmospheric pressure to thoroughly wet the same without dissolution. The slurry is next heated to about 125°C. and 200 psig by external electrical resistance heaters. The flake dissolves to form a dope containing 32 percent by weight cellulose acetate based upon the total weight of the solution. The solution is filtered to remove any extraneous solids by passage through a cotton flannel filter while maintained at 115°C. The filtered solution is fed to the extrusion area while maintained at about 115°C. and about 175 psig by a steam jacket.

The spinneret consists of a jet provided with 20 holes having a diameter of 42 microns arranged in a circular pattern. The jet face temperature of the spinneret is maintained at 107°C. The solution while maintained at about 112°C. is pumped through the spinneret at a rate of 64 grams/minute into air at about 25°C. and at a substantially atmospheric pressure. As the extruded solution enters the air atmosphere it immediately undergoes a phase separation and is converted to solid cellulose acetate yarn of 20 discrete filaments. The extruded solution is present in the air for a residence time of about 0.0005 second before being taken up.

The resulting yarn is collected by winding on a feed roll immediately below the cabinet at a rate of 2023 meters per minute. The drawdown ratio accomplished is 0.84:1. A package containing the yarn product is placed in an air oven maintained at 25°C. until remaining traces of methanol are evolved. The resulting yarn product possesses a denier per filament of 4.57 and is suitable for use in textile applications.

EXAMPLE II

Example I is repeated with the exception that the spinneret consists of 496 holes having a diameter of 32 microns arranged in a pattern of 3 concentric circles. The solution is pumped through the spinneret at a rate of 216 grams/minute into the cabinet to form a multifilament cellulose acetate tow.

The resulting tow passes to a feed roll immediately below the gaseous atmosphere at a rate of 500 meters per minute. A drawdown ratio of about 1.2:1 is accomplished. From the feed roll the tow passes to a crimper, and is deposited on a moving apron. The apron next passes through a circulating air oven maintained at about 80°C. wherein remaining traces of methanol are volatilized. The tow next is baled in a conventional manner. The resulting tow possesses a denier per filament of 2.6 and is suitable for use in the production of cigarette filters.

EXAMPLE III

Example I is repeated with the exception that a solvent consisting of 55 parts by weight acetone and 45 parts by weight water is substituted for the methanol solvent. The solution is maintained at 105°C. when pumped through the spinneret.

Substantially similar results are achieved.

EXAMPLE IV

Example I is repeated with the exception that an ethanol solvent is substituted for the methanol solvent. The solution is maintained at 120°C. when pumped through the spinneret.

Substantially similar results are achieved.

EXAMPLE V

Example I is repeated with the exception that the extrusion orifice is a rectangular slit having a height of 10 mils. A thin continuous film is formed upon extrusion.

The resulting film is passed to the feed roll immediately below the gaseous atmosphere at a rate of 125 meters per minute. From the feed roll the film passes through a circulating air drying oven maintained at about 50°C. wherein remaining traces of methanol are volatilized. The resulting film possesses a thickness of about 3 mils and is suitable for use as a packaging material.

Although the invention has been described with preferred embodiments, it is to be understood that variations may be resorted to as will be apparent to those skilled in the art. Such variations and modifications are to be considered within the purview and scope of the claims appended hereto.

We claim:

1. An improved process for the production of a cellulose acetate filamentary material comprising:

a. dissolving secondary cellulose acetate in a medium selected from the group consisting essentially of (a) a liquid consisting primarily of methanol, (b) a liquid consisting primarily of ethanol, and (c) a liquid comprising about 40 to 60 percent acetone by weight and about 40 to 60 percent water by weight, at a temperature of about 75° to 150°C. while at a superatmospheric pressure of about 75 to 200 psig to form a homogeneous solution, with said medium producing no substantial degradation of said secondary cellulose acetate while dissolved therein and being incapable of dissolving said secondary cellulose acetate at ambient conditions and with at least 50 percent by weight of said medium exhibiting a boiling point below 80°C. at ambient conditions, b. passing said homogeneous solution while at a temperature of about 95° to 120°C. and pressure of about 250 to 500 psig through a shaped extrusion orifice consisting of a plurality of holes having a diameter of about 25 to 200 microns into a gaseous atmosphere provided at substantially atmospheric pressure and at a temperature below the boiling point of said medium wherein said extruded solution undergoes a phase separation wherein the medium separates substantially as a liquid to form a continuous length of a solid cellulose acetate filamentary material consisting of a plurality of discrete continuous filaments, and c. collecting said solid cellulose acetate filamentary material.

2. An improved process according to claim 1 wherein said medium comprises at least 75 percent by weight methanol.

3. An improved process according to claim 1 wherein said medium is substantially all methanol.

4. An improved process according to claim 1 wherein said medium comprises 40 to 60 percent water by weight and about 40 to 60 percent water by weight.

5. An improved process according to claim 1 wherein said medium is ethanol.

6. An improved process according to claim 1 wherein said cellulose acetate is dissolved in said medium in a concentration of about 10 to 50 percent by weight based upon the total weight of the solution.

7. An improved process according to claim 1 wherein said homogenous solution is provided to said shaped extrusion orifice while both the solution and the jet face of said orifice are at a temperature of about 95° to 120°C. and while said solution is under a pressure of about 400 to 500 psig.

8. An improved process according to claim 1 wherein said gaseous atmosphere into which said homogeneous solution is extruded is provided at a temperature of about 10° to 60°C.

9. An improved process according to claim 1 wherein said gaseous atmosphere into which said homogeneous solution is extruded is air.

10. An improved process according to claim 1 wherein said solid cellulose acetate filamentary material is collected by winding upon a support at a rate of about 50 to 5,000 meters per minute.

11. An improved process according to claim 1 which includes the additional step of drying said solid cellulose acetate filamentary material to remove substantially all of said solvent.

12. An improved process for the production of a cellulose acetate filamentary material comprising:

a. dissolving secondary cellulose acetate in methanol at a temperature of about 95° to 120°C. while at a superatmospheric pressure of about 100 to 150 psig to form a homogeneous solution containing about 25 to 45 percent by weight cellulose acetate based upon the total weight of the solution, with said methanol producing no substantial degradation of said secondary cellulose acetate while dissolved therein, b. passing said homogeneous solution while at a temperature of about 95° to 120°C. and a pressure of about 250 to 500 psig through a plurality of adjoining substantially circular extrusion orifices having a diameter of about 25 to 200 microns and a jet face temperature of about 95° to 120°C. into a gaseous atmosphere provided at substantially atmospheric pressure and at a temperature of about 20° to 30°C. wherein said extruded solution undergoes a phase separation wherein said methanol separates substantially as a liquid to form a continuous length of a solid multifilament cellulose acetate filamentary material consisting of a plurality of discrete filaments, and c. collecting said continuous length of filamentary material at a rate of about 50 to 5,000 meters per minute.

13. An improved process according to claim 12 wherein said gaseous atmosphere is air.

14. An improved process according to claim 12 wherein about 20 to 200 of said extrusion orifices are utilized to form a solid continuous filament yarn which is collected by winding upon a support at a rate of about 400 to 2,500 meters per minute.

15. An improved process according to claim 12 wherein about 250 to 10,000 of said extrusion orifices are utilized to form a continuous filament tow which is collected by winding upon a support at a rate of about 200 to 1,000 meters per minute.

16. An improved process according to claim 12 which includes the additional step of drying said continuous length of solid multifilament cellulose acetate filamentary material to remove substantially all of said methanol.

* * * * *